US007602362B2

(12) United States Patent
Park

(10) Patent No.: US 7,602,362 B2
(45) Date of Patent: Oct. 13, 2009

(54) LIQUID CRYSTAL DISPLAY DEVICE AND METHOD FOR DRIVING THE SAME

(75) Inventor: Chul-Woo Park, Suwon-si (KR)

(73) Assignee: Samsung Mobile Display Co., Ltd., Yongin, Gyunggi-Do (KR)

( * ) Notice: Subject to any disclaimer, the term of this patent is extended or adjusted under 35 U.S.C. 154(b) by 842 days.

(21) Appl. No.: 11/280,295

(22) Filed: Nov. 17, 2005

(65) Prior Publication Data

US 2006/0114219 A1 Jun. 1, 2006

(30) Foreign Application Priority Data

Nov. 27, 2004 (KR) ..... 10-2004-0098351

(51) Int. Cl.
*G09G 3/34* (2006.01)

(52) U.S. Cl. ..... 345/89; 345/87; 345/102; 345/212; 345/690

(58) Field of Classification Search ..... 345/87–104, 345/204–215, 690
See application file for complete search history.

(56) References Cited

U.S. PATENT DOCUMENTS 7,453,430 B2 * 11/2008 Park et al. ..... 345/89
7,499,016 B2 * 3/2009 Oh et al. ..... 345/102
7,508,483 B2 * 3/2009 Park et al. ..... 349/199
2006/0125715 A1 * 6/2006 Choi ..... 345/14
2008/0024481 A1 * 1/2008 Lee et al. ..... 345/212
2008/0055289 A1 * 3/2008 Kim et al. ..... 345/204

FOREIGN PATENT DOCUMENTS

| | | |
|---|---|---|
| JP | 03-293318 | 12/1991 |
| JP | 06-130906 | 5/1994 |
| JP | 09-023441 | 1/1997 |
| JP | 2003-208136 | 7/2003 |
| JP | 2004-20747 | 1/2004 |

OTHER PUBLICATIONS

Korean Office action for Korean patent application No. 10-2004-0098351 issued on Aug. 7, 2006.
Japanese Office action for Japanese patent application No. 2005-236091 issued on Nov. 4, 2008.

* cited by examiner

*Primary Examiner*—Vijay Shankar
(74) *Attorney, Agent, or Firm*—Robert E. Bushnell, Esq.

(57) ABSTRACT

A liquid crystal display (LCD) device and a method of operating the same prevents a tearing effect from occurring. The LCD device includes a frame memory for writing new red, green and blue data or reading previously written red, green and blue data according to address designation, and a detector which outputs a cut off signal for cutting off operation of a light source controller or a gradation voltage generating portion when the new red, green and blue data are written to the frame memory before the written red, green and blue data are read from the frame memory.

20 Claims, 4 Drawing Sheets

LIQUID CRYSTAL DISPLAY DEVICE AND METHOD FOR DRIVING THE SAME

CLAIM OF PRIORITY

This application makes reference to, incorporates the same herein, and claims all benefits accruing under 35 U.S.C. §119 from an application earlier filed in the Korean Intellectual Property Office on Nov. 27, 2004 and there duly assigned Serial No. 2004-98351.

BACKGROUND OF THE INVENTION

1. Technical Field

The present invention relates to a liquid crystal display (LCD) device and, more particularly, to an LCD device for preventing occurrence of a tearing effect, and a method for driving the LCD device.

2. Related Art

Recently, display devices have been designed so as to be lightweight and thin like personal computers (PCs) and televisions. For example, the cathode ray tube (CRT) has been replaced by a flat panel display device, such as an LCD device.

The LCD device obtains a desired image signal by application of an electric field to a liquid crystal having dielectric constant anisotropy, the liquid crystal being injected between two substrates, and by controlling the intensity of the electric field so as to control the amount of light, from a backlight, transmitted toward the substrates.

The LCD device is one of most popular flat panel display devices, and a thin film transistor liquid crystal display (TFT-LCD) device is well known.

The LCD device has two driving methods which are classified according to the method for displaying the color image: the color filter method; and the field sequential method.

The LCD device of the color filter method displays a desired image by controlling the amount of light provided to a color filter layer with red (R), green (G) and blue (B) color filters formed on one of the two substrates. That is, the LCD device of the color filter method displays a desired image by controlling the amount of light emitted from a single light source and transmitted to the color filter layer so as to synthesize R, G and B colors.

The LCD device which employs the signal light source and the three-color filter layer to display an image requires unit pixels which respectively correspond to respective R, G and B regions, and thus requires three times as many pixels as a black and white LCD device does. Thus, in order to achieve a high-resolution image, precise technology is required in manufacturing the LCD panel. In addition, it is inconvenient to manufacture because such an LCD device needs the color filter layer, and the brightness is low since light transmittance of the color filter itself is low.

Meanwhile, the LCD device of the field sequential method obtains a full-color image by periodically turning on an independent light source corresponding to R, G and B colors, and color signals corresponding to respective pixels are provided so as to be synchronous with the periodic ON condition. That is, the LCD device of the field sequential method does not define pixels as R, G and B unit pixels, but time-divisionally and sequentially displays R, G and B colors outputted from R, G and B back lights so as to display an image using persistence of vision.

The field sequential driving method is classified into an analog driving method and a digital driving method.

The analog driving method sets a plurality of gradation voltages corresponding to a gradation number, selects one gradation voltage corresponding to gradation data from the gradation voltages, and drives a liquid crystal panel by the selected gradation voltage, so that gradation is displayed by the amount of light to be transmitted in correspondence to the applied gradation voltage.

The digital driving method displays gradation by applying a driving voltage to a liquid crystal constant, and controlling the voltage application time. According to the digital driving method, gradation is displayed by maintaining the driving voltage constant so as to control the accumulated amount of light to be transmitted to the liquid crystal.

In this LCD device, when a frame frequency displayed on a screen and a frequency of data inputted do not match each other, a tearing effect phenomenon occurs in that two or more kinds of data (i.e., data of two more frames) are displayed as a single data. Due to the tearing effect, in the case of the LCD device of the color filter method, data of two or more frames are divisionally displayed as a single data, and in the case of the field sequential method, a certain R, G or B color is updated with data of the next frame so that a different color is displayed, resulting in phenomenon such as dot crawl.

In order to resolve the above problems, the LCD device of the color filter method has been employed by changing a frame frequency displayed on a screen at the same speed as a frequency of data inputted. However, the method for changing the frequency can cause a problem in that it adversely affects gradation when it is applied to the LCD device of the field sequential method. It is because the field sequential method requires a frequency which is three times faster than that required by the color filter method since it is driven in such a way that one frame is divided into an R field, a G field and a B field. However, if frequency is changed to resolve the tearing effect, a problem in representation of gradation may occur.

SUMMARY OF THE INVENTION

It is an object of the present invention to provide an LCD device and a method for driving the same in which the tearing effect is prevented so that data of the next frame can be updated while data of a current frame is displayed.

In one aspect of the present invention, a liquid crystal display device comprises: a liquid crystal (LC) panel including a plurality of scan lines for transferring scan signals, a plurality of data lines for crossing the scan lines, and a plurality of pixel circuits arranged at crossing points of the data lines and the scan lines; a light source controller for controlling red, green and blue LEDs to sequentially emit red, green and blue lights toward the LC panel; a scan driver for applying the scan signals to the plurality of scan lines; a data driver for outputting gradation voltages of red, green and blue to the plurality of data lines; a gradation voltage generating portion for outputting gradation voltage corresponding to red, green and blue data to the data driver; and a timing controller for outputting the red, green and blue data to the gradation voltage generating portion, and for controlling operation of the data driver and the light source controller; wherein the timing controller includes a frame memory for writing new red, green and blue data according to address designation, or reading written red, green and blue data, and a detector for outputting a cut off signal for cutting off operation of the light source controller when the new red, green and blue data are written before the written red, green and blue data are read.

In another aspect of the present invention, a method of driving a liquid crystal display device which includes an LC panel, a light source controller for controlling red, green and blue LEDs to sequentially emit red, green and blue lights toward the LC capacitor, a gradation voltage generating portion for outputting gradation voltage corresponding to red, green and blue data to a data driver, and a timing controller having a frame memory for outputting the red, green and blue data to the gradation voltage generating portion and a detector for controlling operation of the light source controller, the method comprising the steps of: reading the red, green and blue data from the frame memory; and writing new red, green and blue data to the frame memory; wherein the detector comprises a write address to which the new red, green and blue data are to be written and a read address from which the red, green and blue data are to be read, and the detector outputs a cut off signal for cutting off operation of the light source controller when the write address is faster than the read address.

In another aspect of the present invention, a liquid crystal display device, comprises: an LC panel which includes a plurality of scan lines for transferring scan signals, a plurality of data lines for crossing the scan lines, and a plurality of pixel circuits arranged at crossing points of the scan lines and the data lines; a light source controller for controlling red, green and blue LEDs to sequentially emit red, green and blue lights toward the LC panel; a scan driver for applying the scan signals to the plurality of scan lines; a data driver for outputting gradation voltages of red, green and blue to the plurality of data lines; a gradation voltage generating portion for outputting gradation voltage corresponding to red, green and blue data to the data driver; and a timing controller for outputting the red, green and blue data to the gradation voltage generating portion, and for controlling operation of the data driver and the light source controller; wherein the timing controller includes a frame memory for writing new red, green and blue data according to address designation or reading written red, green and blue data, and a detector for outputting a cut off signal for cutting off operation of the gradation voltage generating portion when the new red, green and blue data are written before the written red, green and blue data are read.

In another aspect of the present invention, a method of driving a liquid crystal display device which includes an LC panel, a light source controller for controlling red, green and blue LEDs to sequentially emit red, green and blue lights toward the LC capacitor, a gradation voltage generating portion for outputting gradation voltage corresponding to red, green and blue data to a data driver, a timing controller having a frame memory for outputting the red, green and blue data to the gradation voltage generating portion, and a detector for controlling operation of the light source controller, the method comprising the steps of: reading the red, green and blue data from the frame memory; and writing new red, green and blue data to the frame memory; wherein the detector comprises a write address to which the new red, green and blue data are to be written and a read address from which the red, green and blue data are to be read, and the detector outputs a cut off signal for cutting off operation of the gradation voltage generating portion when the write address is faster than the read address.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
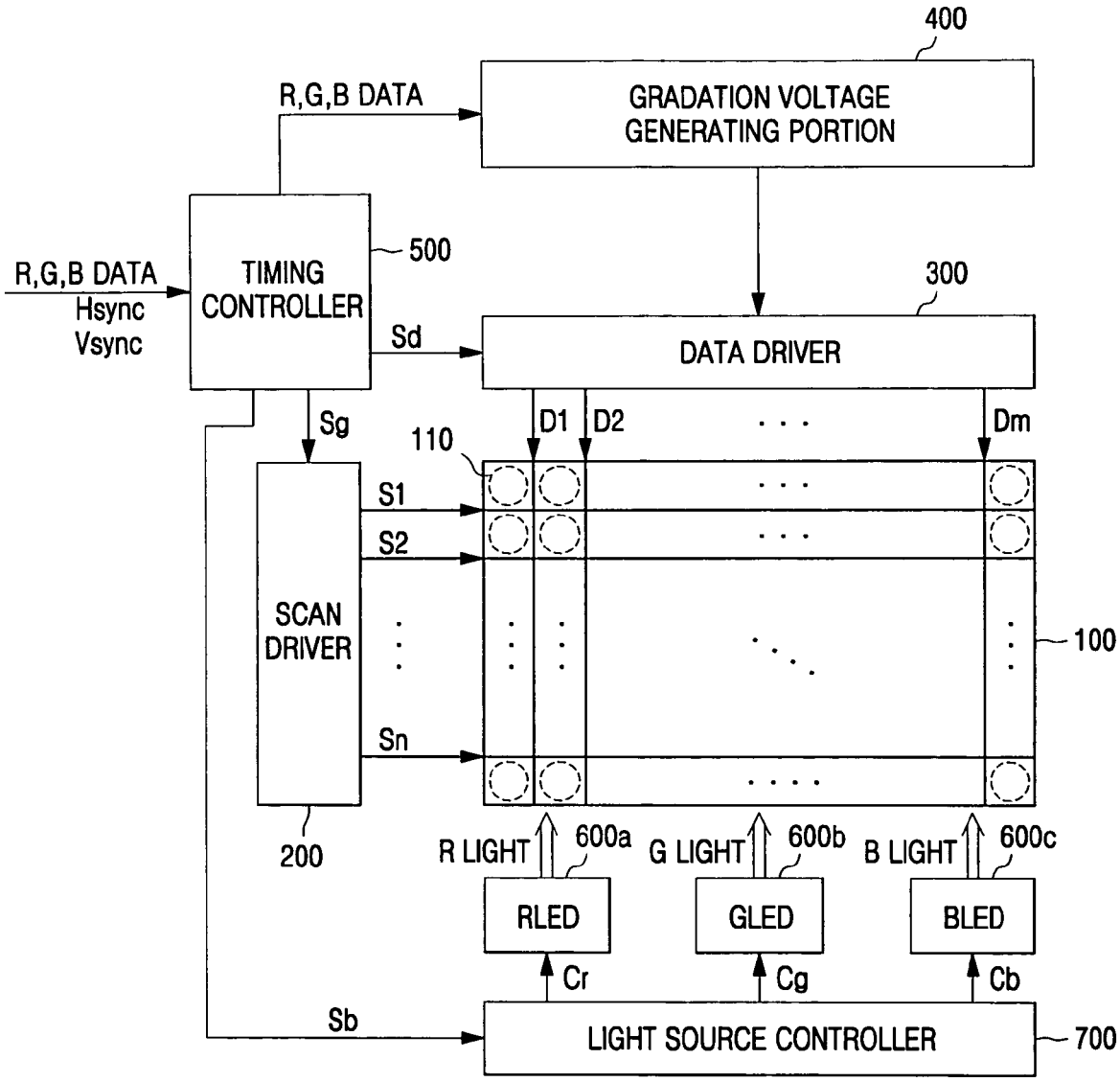
FIG. 1 is a block diagram of an LCD device according to the present invention.

The present invention will now be described more fully hereinafter with reference to the accompanying drawings, in which preferred embodiments of the invention are shown. This invention may, however, be embodied in different forms, and should not be construed as limited to the embodiments set forth herein. Rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout the specification.

Figure 2:
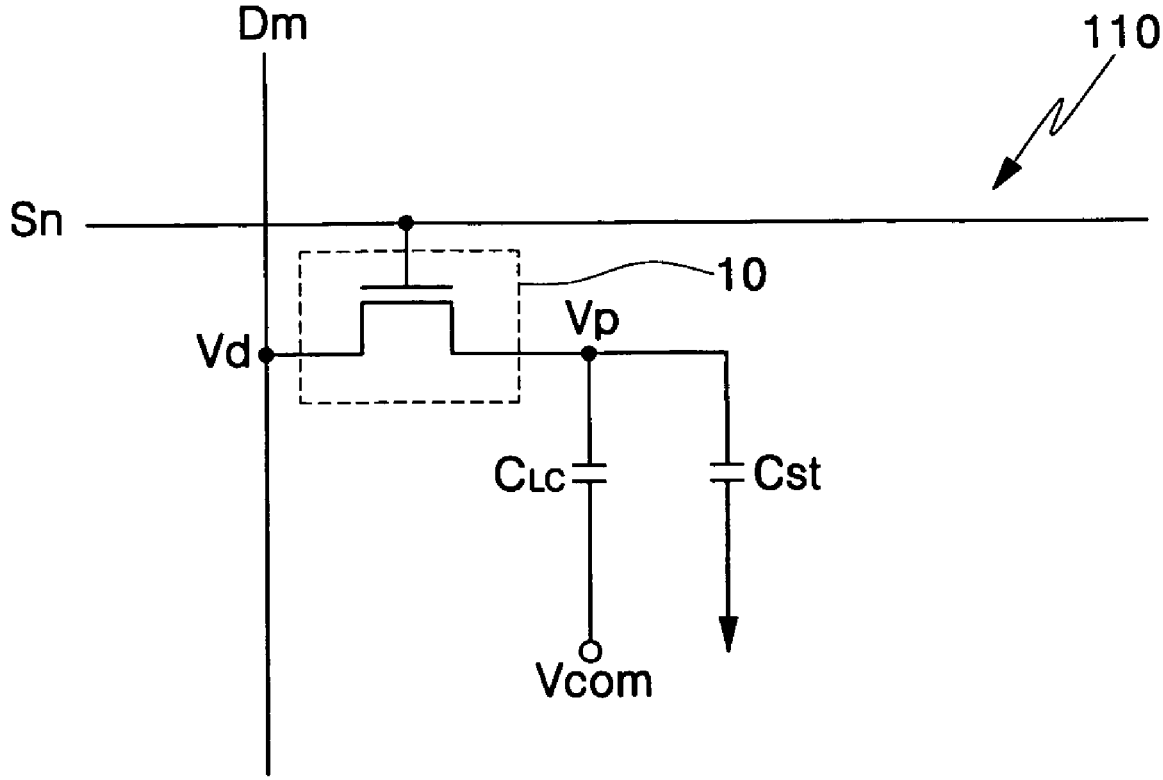
FIG. 2 is a circuit diagram of an equivalent circuit of one pixel of the LCD device according to the present invention.

FIG. 1 is a block diagram of an LCD device according to the present invention, and FIG. 2 is a circuit diagram of an equivalent circuit of one pixel of the LCD device according to the present invention. 100, a scan driver 200, a data driver 300, a gradation voltage generating portion 400, a timing controller 500, LEDs 600*a* to 600*c* which produce R, G and B lights, respectively, and a light source controller 700.

The LC panel 100 includes a plurality of display signal lines S1 to Sn and D1 to Dm and a plurality of pixel circuits 110 arranged in a matrix so as to be connected to the display signal lines S1 to Sn and D1 to Dm, as can be seen in the equivalent circuit of FIG. 2.

The display signal lines S1 to Sn and D1 to Dm includes a plurality of scan lines S1 to Sn which transfer gate signals (i.e., scan signals) and a plurality of data lines D1 to Dm which transfer data signals. The scan lines S1 to Sn are arranged in a transverse direction and in parallel with each other, and the data lines D1 to Dm are arranged in a vertical direction and in parallel with each other.

Each pixel circuit 110 includes a thin film transistor (TFT) 10 connected to the display signal lines S1 to Sn and D1 to Dm, an LC capacitor CLC connected to the TFT 10, and a storage capacitor Cst.

The TFT 10 is a three-terminal element which has a gate connected to the scan lines S1 to Sn, a source connected to the data lines D1 to Dm, and a drain connected to the LC capacitor CLC and the storage capacitor Cst.

The LC capacitor CLC includes a pixel electrode (not shown) and a common electrode (not shown) which function as two electrodes thereof, and a liquid crystal layer which functions as a dielectric layer. The pixel electrode is connected to the drain of the TFT, and the common electrode is supplied with a common voltage Vcom.

The storage capacitor Cst is formed by overlapping of a lower electrode (not shown) and the pixel electrode. The lower electrode is connected to the common electrode so as to be supplied with a common voltage Vcom.

Referring to FIG. 2, a gate signal is applied to the scan line Sn to turn on the TFT 10, and a data voltage Vd supplied to the data line Dm is applied to the pixel electrode through the TFT 10. As a result, an electric field corresponding to the difference between a pixel voltage Vp applied to the pixel electrode and a common voltage Vcom is applied to a liquid crystal (i.e., CLC capacitor in FIG. 2 as an equivalent), so that light is transmitted at a transmittance corresponding to the intensity of the electric field. At this point, a pixel voltage Vp is maintained during one frame or one field by the storage capacitor Cst.

Returning back to FIG. 1, the scan driver 200 sequentially applies scan signals to the scan lines S1 to Sn so as to turn on a TFT whose gate is connected to the scan line to which the scan signal is applied.

The gradation voltage generating portion 400 generates gradation voltages having amplitudes corresponding to R, G and B data, respectively, and provides them to the data driver 300. The data driver 300 applies the gradation voltage outputted from the gradation voltage generating portion 400 to corresponding data lines.

The timing controller 500 receives R, G and B image signals (R, G and B data) and input control signals for controlling display of these image signals, such as a vertical synchronous signal Vsync and a horizontal synchronous signal Hsync.

The timing controller 500 processes the image signals (R, G and B data) according to the operational condition of the LC panel 100 based on the input image signals (R, G and B data) and the input control signals, and produces a gate control signal Sg, a data control signal Sd, and a light source control signal Sb. The gate control signal Sg is transmitted to the scan driver 200, the data control signal Sd is transmitted to the data driver 300, the processed image signals (R, G and B data) are transmitted to the gradation voltage generating portion 400, and the light source control signal Sb is transmitted to the light source controller 700.

The timing controller 500 includes a frame memory for storing or outputting the input image signal (R, G and B data) in a frame unit. Furthermore, the timing controller 500 includes a detector which detects the tearing effect by comparing an address of the image signal (e.g., (N+1)th R, G and B data) newly written in the frame memory and an address from which the image signal (e.g., Nth R, G and B data) already stored in the frame memory is outputted. The detector detects the tearing effect which occurs because data of an (N+1)th frame is updated (written) in the frame memory while data of Nth frame from the frame memory is read, and applies a cut-off signal Sb for cutting off the LEDs 600*a* to 600*c* to the light source controller 700, or applies a cut-off signal for cutting off an output of data gradation voltage to the gradation voltage generating portion 400, thereby preventing the tearing effect.

The LEDs 600*a* to 600*c* output R, G and B light, respectively, to the LC panel 100. The light controller 700 controls ON conditions of the LEDs 600*a* to 600*c*. A point in time at which gradation data are supplied to the data line Dm from the data driver 300, and a point in time at which the R, G and B LEDs 600*a* to 600*c* are turned on or off by the light source controller 700, may be synchronized by a control signal supplied by the timing controller 500.

The display operation of the LCD device of the present invention is explained below with reference to FIG. 3.

Figure 3:
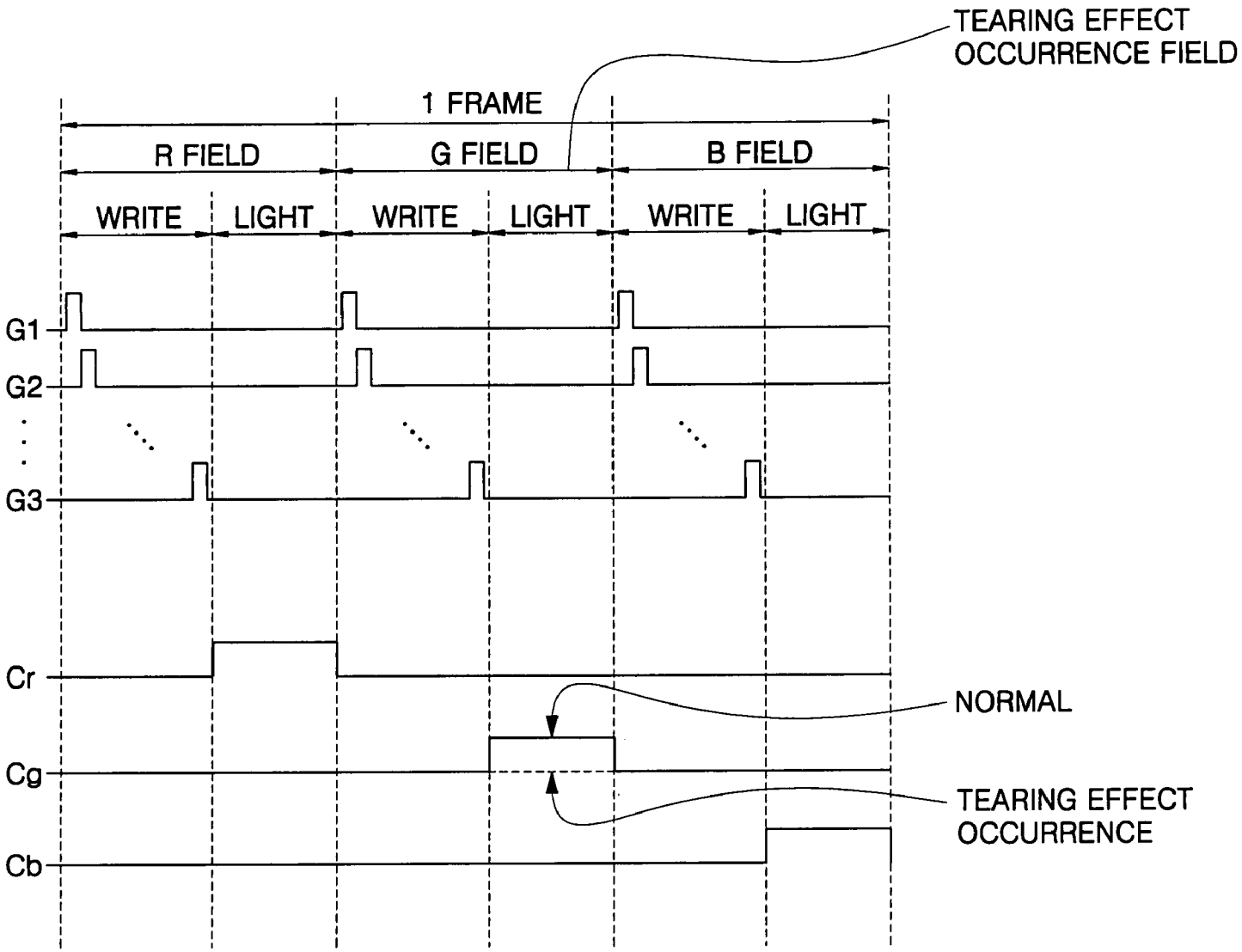
FIG. 3 is a timing diagram of the operation of the LCD device.

FIG. 3 is a timing diagram of the operation of the LCD device.

Referring to FIG. 3, the LCD device of the present invention divides one frame into three fields: an R field; a G field; and a B field. If the driving frequency of one frame is 60 Hz, each field is synchronous with 180 Hz, so that display operation is performed. In this regard, G1 to Gn denote scan signals applied to the scan lines and Cr, Cg, and Cb denote ON signals for causing ON conditions of the R, G and B LEDs 600*a* to 600*c*, respectively.

R, G and B image data corresponding to one frame, as supplied from an external portion, are divided into R image data, G image data and B image data corresponding to one frame, are converted, and are then stored in the frame memory (which may be included in the timing controller) by the timing controller 500 according to display operation of the LCD device. The respective stored R, G and B image data are outputted so that the R image data are first outputted during an R field period of 1/180second which is a third (1/3) of one frame, the G image data are next outputted during the G field period, and the B image data are then outputted during the B field period, in sequence, by means of an output signal from the timing controller 500.

An R image data voltage is sequentially entered into all pixels according to the scan signals G1 to Gn during an R field entry period, and then the LED 600*a* is turned on according to the ON signal Cr during a lighting period, so that the R image is displayed on the LC panel 100.

A G image data voltage is sequentially entered into all pixels according to the scan signals G1 to Gn during a G field entry period, and then the LED 600*b* is turned on according to the ON signal Cg during a lighting period, so that the G image is displayed on the LC panel 100.

A B image data voltage is sequentially entered into all pixels according to the scan signals G1 to Gn during a B field entry period, and then the LED 600*b* is turned on according to the ON signal Cb during a lighting period, so that the B image is displayed on the LC panel 100.

In the manner described above, by sequentially displaying images corresponding to respective R, G and B color components during every R, G and B field, the images of R, G and B color components are synthesized by persistence of vision so as to be recognized as a color image of one frame.

However, when R, G and B images of Nth frame data should be sequentially entered during one frame, but the R image data of the Nth frame are entered and the LED 600*a* is turned on according the ON signal Cr, so that the R image is displayed on the LC panel 100, and image data of the (N+1)th frame is entered while G image data is entered, that is, when the tearing effect occurs, the ON signal Cg is transmitted during the G lighting period, so that (N+1)th image data which is erroneously entered is not displayed on the LC panel 100. Although not shown in FIG. 3, when the tearing effect occurs, it is also possible to prevent corresponding data from being outputted so that the (N+1)th image data cannot be displayed.

As described above, the LCD device of the present invention detects a point in time at which the tearing effect occurs, and momentarily turns off the LED or does not output data, thereby precluding or eliminating the tearing effect.

In FIG. 3, an image is displayed such that each field is divided into an entry period and a lighting period, but the present invention is not limited to this. For example, each field may include a reset period for removing data voltage which is applied during a previous field.

A method for resolving the tearing effect problem in the LCD device is explained below in detail with reference to FIGS. 4 and 5.

Figure 4:
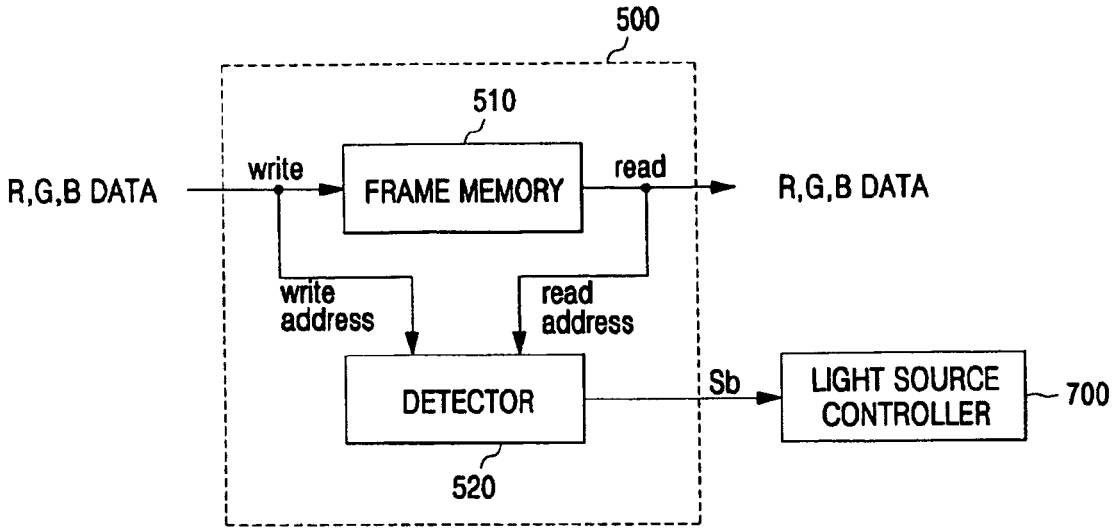
FIG. 4 is a block diagram of one embodiment of a timing controller according to the present invention.

FIG. 4 is a block diagram of one embodiment of the timing controller according to the present invention.

In FIG. 4, the timing controller includes a frame memory for storing and outputting R, G and B data and a detector for detecting the tearing effect. The timing controller can include other components which are omitted from the drawing for convenience.

Referring to FIG. 4, one embodiment of the timing controller 500 includes a frame memory 510 and a detector 520.

The frame memory 510 separately stores or outputs R, G and B data which correspond to one frame. That is, R, G and B data (e.g., R, G and B data of the Nth frame) which should be outputted during a current frame (e.g., the Nth frame) are written to the frame memory 510 from an external graphic controller (not shown). At this point, the R, G and B data of the Nth frame are updated to the frame memory 510 according to a write address command. The R, G and B data of the Nth frame of a corresponding address are sequentially outputted, i.e., read to the gradation voltage generating portion 400 according to a read address command. The frame memory 510 is a dual-port random access memory (RAM) which can write and output the R, G and B data.

The detector 520 compares a write address of the R, G and B data of a frame written to the frame memory 510 and a read address of the R, G and B data of a frame outputted to the gradation voltage generating portion 400. If the write address is slower than the read address, the detector 520 outputs a control signal Sb for cutting off the LED to the light source controller 700.

A procedure for detecting the tearing effect in the timing controller of FIG. 4 is explained below in detail.

Assuming that the frame memory 510 has addresses 1 to 10 and write and read operations are performed in ascending order of address, R, G and B data of the Nth frame previously stored are read from the address 1 during a read operation, and if R, G and B data of the (N+1)th frame are written to the address 4 when R, G and B data of the address 4 are read during a write operation, R, G and B data of the (N+1)th frame of the address 5 newly written, other than R, G and B data of the Nth frame of the address 5 previously stored, are read during a read operation, whereby a different color is displayed, that is, the tearing effect occurs. In this case, the read operation of R, G and B data of the Nth frame may be first performed, and then the write operation of R, G and B data of the (N+1)th frame may be performed, and also the read and write operations may be simultaneously performed.

At this point, the detector 520 compares the write address and the read address of the frame memory 510 to determine whether the write address is faster than the read address, and outputs a cut-off signal for cutting off light emission of a corresponding LED to the light source controller 700 when the write address is faster than the read address. That is, when new R, G and B data are read before R, G and B data written in the frame memory 510 are read, the detector 520 outputs a cut-off signal. In summary, the detector 520 outputs a cut-off signal for cutting off light emission of the LED in the case of Formula 1:

$$\text{Write address} > \text{read address} \qquad \text{Formula 1.}$$

In the latter regard, R, G and B data to be written to the write address are data of the (N+1)th frame, and R, G and B data to be read from the read address are data of the Nth frame.

Except for the case of Formula 1, the detector 520 outputs an operation signal for light emission of the LED to the light source controller 700.

The timing controller 500 of the LCD device, according to the present invention, detects a tearing effect in that data of the (N+1)th frame is written to the frame memory while data of the Nth frame is read, so that an image is displayed on the LC panel, and thus momentarily cuts off light emission of the LED, thereby eliminating the tearing effect.

Figure 5:
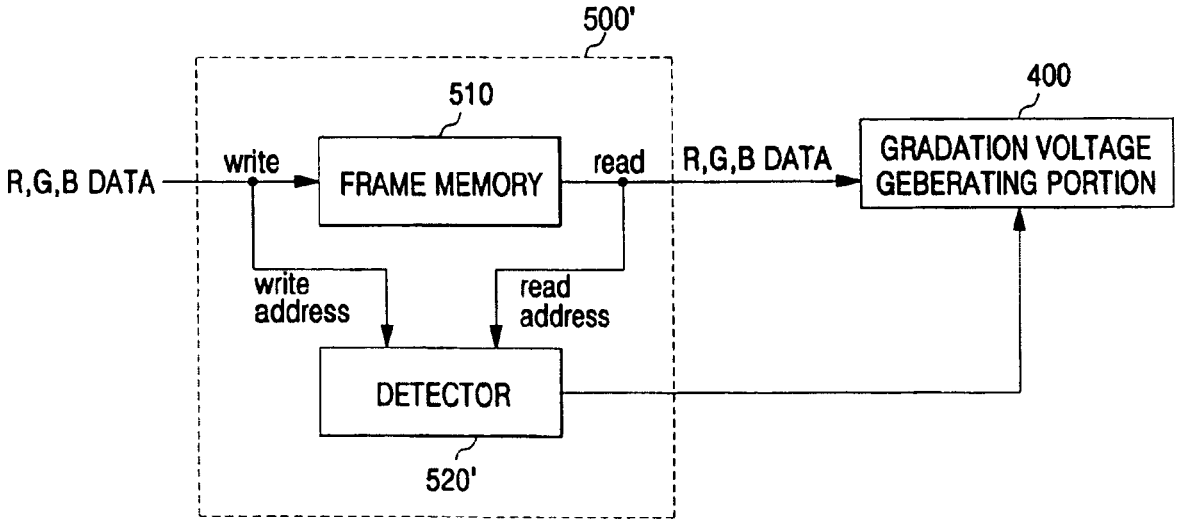
FIG. 5 is a block diagram of another embodiment of the timing controller according to the present invention.

FIG. 5 is a block diagram of another embodiment of the timing controller according to the present invention.

Referring to FIG. 5, another embodiment of the timing controller 500' includes a frame memory 510 and a detector 520'.

The frame memory 510 separately stores or outputs R, G and B data of one frame. That is, R, G and B data (e.g., R, G and B data of the Nth frame) which should be outputted during a current frame (e.g., the Nth frame) are written to the frame memory 510 from an external graphic controller (not shown). At this point, the R, G and B data of the Nth frame are updated to the frame memory 510 according to a write address command. The R, G and B data of the Nth frame of a corresponding address are sequentially outputted, i.e., read to the gradation voltage generating portion 400, according to a read address command. In this case, the frame memory 510 is a dual-port RAM which can write and output the R, G and B data.

The detector 520' compares a write address of the R, G and B data written to the frame memory 510 and a read address of the R, G and B data read to the gradation voltage generating portion 400. If the write address is slower than the read address, the detector 520' outputs a cut off signal for cutting off output of R, G and B data to the gradation voltage generating portion 400. That is, the detector 520' outputs a cut off signal in the case where new R, G and B data are written before R, G and B data written in the frame memory 510 are outputted.

The procedure for detecting the tearing effect in the timing controller of FIG. 5 is similar to that of FIG. 4, and thus description thereof is omitted.

The detector 520' outputs a cut-off signal for cutting off the output of R, G and B data corresponding to the write address to the gradation voltage generating portion 400 in the case where Formula 1 is satisfied, thereby preventing the tearing effect from occurring.

Except for the case of Formula 1, the detector 520' outputs an operation signal to the light source controller 700 so that R, G and B gradation voltages can be outputted.

In the above embodiments of the present invention, the frame memory 510 for storing R, G and B data and the detectors 520 and 520' for detecting the tearing effect are included in the timing controller 500. But, the present invention is not limited to this. For example, the frame memory 510 and the detectors 520 and 520' maybe included in the data driver 300, or they may be provided separately.

The LCD device according to the present invention detects the tearing effect whereby data of (N+1)th frame is written to the frame memory before R, G and B data of the Nth frame is read, and thus the LCD device momentarily cuts off light emission of the LED or output of data voltage to the LC panel, thereby eliminating the tearing effect.

As described herein above, the LCD device according to the present invention detects the tearing effect whereby data of (N+1)th frame is written to the frame memory before R, G and B data of Nth frame is read, and thus momentarily cuts off light emission of the LED or output of R, G and B data gradation voltage to the LC panel, thereby eliminating the tearing effect.

Although preferred embodiments of the present invention have been described in detail, it will be appreciated by those skilled in the art to which the present invention pertains that several modifications and variations can be made without departing from the spirit and scope of the present invention as defined in the appended claims. Accordingly, future variations of the embodiments of the present invention can be covered by the technique of the present invention.

What is claimed is:

1. A liquid crystal display device, comprising:

a liquid crystal (LC) panel including a plurality of scan lines for transferring scan signals, a plurality of data lines crossing the scan lines, and a plurality of pixel circuits arranged at crossing points of the scan lines and the data lines;

a light source controller for controlling red, green and blue light emitting diodes (LEDs) so as to sequentially emit red, green and blue lights to the LC panel;

a scan driver for applying the scan signals to the plurality of scan lines;

a data driver for outputting gradation voltages of red, green and blue to the plurality of data lines;

a gradation voltage generating portion for outputting gradation voltages corresponding to red, green and blue data to the data driver; and a timing controller for outputting the red, green and blue data to the gradation voltage generating portion, and for controlling operation of the data driver and the light source controller;

wherein the timing controller includes a frame memory for writing new red, green and blue data according to address designation and for reading written red, green and blue data, and a detector for outputting a cut off signal for cutting off operation of the light source controller when the new red, green and blue data are written before the written red, green and blue data are read.

2. The device of claim 1, wherein the detector compares a write address of the new red, green and blue data and a read address of the written red, green and blue data, and outputs the cut off signal when the write address is faster than the read address.

3. The device of claim 1, wherein the red, green and blue data read from the frame memory are data of an Nth frame, and the new red, green and blue data written to the frame memory are data of an (N+1)th frame.

4. The device of claim 1, wherein the frame memory comprises a dual-port random access memory (RAM) having an input port to which the new red, green and blue data are written and an output port from which the written red, green and blue data are outputted.

5. The device of claim 4, wherein the detector includes a first input terminal connected to the input port, a second input terminal connected to the output port, and an output terminal connected to the light source controller.

6. The device of claim 1, wherein each pixel circuit comprises:

a switching transistor for transferring red, green and blue data which are sequentially transferred through a data line in response to a selecting voltage of a scan line;

an LC capacitor for transmitting lights of the red, green and blue LEDs according to red, green and blue data voltages; and a storage capacitor parallel-connected to the LC capacitor for maintaining the red, green and blue data voltages during one frame.

7. A method of driving a liquid crystal display device which includes a liquid crystal (LC) panel, a light source controller for controlling red, green and blue light emitting diodes (LEDs) to sequentially emit red, green and blue lights toward the LC panel, a gradation voltage generating portion for outputting gradation voltages corresponding to red, green and blue data to a data driver, a timing controller having a frame memory for outputting the red, green and blue data to the gradation voltage generating portion, and a detector for controlling operation of the light source controller, the method comprising the steps of:

reading the red, green and blue data from the frame memory; and writing new red, green and blue data to the frame memory;

wherein the detector comprises a write address to which the new red, green and blue data are written and a read address from which the red, green and blue data are read; and wherein the detector outputs a cut off signal for cutting off operation of the light source controller when the write address is faster than the read address.

8. The method of claim 7, wherein the red, green and blue data read from the frame memory are data of an Nth frame, and the new red, green and blue data written to the frame memory are data of an (N+1)th frame.

9. The method of claim 7, wherein the step of writing is performed at the same time as the step of reading.

10. The method of claim 7, wherein the detector outputs an operation signal for operation of the light source controller when the write address is slower than the read address.

11. A liquid crystal display device, comprising:

a liquid crystal (LC) panel including a plurality of scan lines for transferring scan signals, a plurality of data lines crossing the scan lines, and a plurality of pixel circuits arranged at crossing points of the scan lines and the data lines;

a light source controller for controlling red, green and blue light emitting diodes (LEDs) to sequentially emit red, green and blue lights toward the LC panel;

a scan driver for applying the scan signals to the plurality of scan lines;

a data driver for outputting gradation voltages of red, green and blue to the plurality of data lines;

a gradation voltage generating portion for outputting gradation voltages corresponding to red, green and blue data to the data driver; and a timing controller for outputting the red, green and blue data to the gradation voltage generating portion, and for controlling operation of the data driver and the light source controller;

wherein the timing controller includes a frame memory for writing new red, green and blue data according to address designation and reading written red, green and blue data, and a detector for outputting a cut off signal for cutting off operation of the gradation voltage generating portion when the new read, green and blue data are written before the written red, green and blue data are read.

12. The device of claim 11, wherein the detector compares a write address of the new red, green and blue data and a read address of the read red, green and blue data, and outputs the cut off signal when the write address is faster than the read address.

13. The device of claim 11, wherein the red, green and blue data read from the frame memory are data of an Nth frame, and the new red, green and blue data written to the frame memory are data of an (N+1)th frame.

14. The device of claim 11, wherein the frame memory is a dual-port random access memory (RAM) having an input port to which the new red, green and blue data are to be written and an output port from which the red, green and blue data are outputted.

15. The device of claim 14, wherein the detector includes a first input terminal connected to the input port, a second input terminal connected to the output port, and an output terminal connected to the light source controller.

16. The device of claim 11, wherein each pixel circuit includes:

a switching transistor for transferring red, green and blue data which are sequentially transferred through a data line in response to a selecting voltage of the scan line;

an LC capacitor for transmitting lights of the red, green and blue LEDs according to the red, green and blue data voltages; and a storage capacitor parallel-connected to the LC capacitor for maintaining the red, green and blue data voltages during one frame.

17. A method of driving a liquid crystal display device which includes a liquid crystal (LC) panel, a light source controller for controlling red, green and blue light emitting diodes (LEDs) to sequentially emit red, green and blue lights toward the LC panel, a gradation voltage generating portion for outputting gradation voltages corresponding to red, green and blue data to a data driver, and a timing controller having a frame memory for outputting the red, green and blue data to the gradation voltage generating portion and a detector for controlling operation of the light source controller, the method comprising the steps of:

reading the red, green and blue data from the frame memory; and writing new red, green and blue data to the frame memory;

wherein the detector comprises a write address to which the new red, green and blue data are written and a read address from which the red, green and blue data are read; and wherein the detector outputs a cut off signal for cutting off operation of the gradation voltage generating portion when the read address is faster than the read address.

18. The method of claim 17, wherein the red, green and blue data read from the frame memory are data of an Nth frame, and the new red, green and blue data written to the frame memory are data of an (N+1)th frame.

19. The method of claim 17, wherein the step of writing is performed at the same time as the step of reading.

20. The method of claim 17, wherein the detector outputs an operation signal for operation of the gradation voltage generating portion when the write address is slower than the read address.

* * * * *